US005501560A

United States Patent [19]

Blume

[11] Patent Number: 5,501,560

[45] Date of Patent: Mar. 26, 1996

[54] MAILABLE DOCUMENTS, APPARATUS AND METHOD

[76] Inventor: Robert H. Blume, The Old Forge, 41 Park Road, Hartwell, Northamptonshire, England

[21] Appl. No.: 129,202

[22] PCT Filed: Dec. 9, 1993

[86] PCT No.: PCT/GB93/00283

§ 371 Date: Oct. 8, 1993

§ 102(e) Date: Oct. 8, 1993

[87] PCT Pub. No.: WO93/15990

PCT Pub. Date: Aug. 19, 1993

[30] Foreign Application Priority Data

Feb. 12, 1992 [GB] United Kingdom ..... 9202958

[51] Int. Cl.[6] ..... B42C 9/00

[52] U.S. Cl. ..... 412/37

[58] Field of Search ..... 281/2, 5; 283/116; 412/1, 37; 270/45

[56] References Cited

U.S. PATENT DOCUMENTS 4,597,591 7/1986 Gendron et al. ..... 283/116 X

*Primary Examiner*—Willmon Fridie, Jr.
*Attorney, Agent, or Firm*—Albert O. Cota

[57] ABSTRACT

This invention relates to mailable documents, apparatus and method, and relates particularly to mailable documents apparatus and method suited to the high speed automated folding and sealing of pre-printed sheets.

10 Claims, 8 Drawing Sheets

MAILABLE DOCUMENTS, APPARATUS AND METHOD

FIELD OF THE INVENTION

This invention relates to mailable documents, apparatus and method, and relates particularly to mailable documents apparatus and method suited to the high speed automated folding and sealing of pre-printed sheets.

Government departments and commercial organisations frequently need to mail documents pre-printed with a standard message (or in standardised format such as pension advice notes, itemising the benefits to which the recipient is entitled) to a large number of recipient addresses.

In order to mail such documents, it has long been standard practice to insert the document in a pre-formed and separate envelope. However a "self mailer", in the form of a sheet on which the address information and the message information has already been printed, has many potential advantages. Such advantages include that the sheet when folded and sealed itself forms a mailpiece, without the need (a) for a separate envelope and (b) the equipment to insert the document in the envelope.

DESCRIPTION OF THE PRIOR ART

An early example of a "self-mail" sheet is the well-known airmail letter sheet. However this is supplied pre-gummed, and so is not particularly suited to folding and sealing by machine.

U.S. Pat. No. 4,701,233 discloses concurrent folding and sealing of a pre-printed sheet. The adhesive is however applied to side edge portions of the printed face of the sheet (from "above" the flow path of the paper through the machine) and within a bulging sheet portion. Adhesive is finally applied to side edge portions of the sheet from below the flow path, and the trailing address region of the sheet is reverse folded onto the previously-treated interleaved sections. A disadvantage of this proposal is that the adhesive is applied to a non-planar sheet portion, and during a bulge-fold sequence. Another disadvantage is that the adhesive must be of significantly lower rupture strength than the sheet material so that the recipient can break the adhesive to ascertain the printed information. Another disadvantage is that no lateral sealing is provided, so that at least part of the printed information could become visible if an exposed fold is lifted, such lifting being perhaps necessary if a finger or other opener is to be inserted between laterally-spaced longitudinally extending glue lines. Additional exit rollers are needed if the address section following folding is to pass between more than a single pair of squeeze rollers.

European Patent Application 0,448,271 discloses a folder and sealer mechanism for the side flaps and the trailing flap of an "envelope" form, designed to be folded around accumulated printed or pre-printed sheets. Water responsive adhesive is pre-applied to the flaps, as a "line" to each side flap and as transversly spaced "spots" to the trailing flap. As the accumulation is transported into the folder and sealer by a roller pair, the flaps are moistened to activate the adhesive; the accumulation is then fed to a first sealing roller assembly, comprising an upper roller with segments positioned to pass between the spots of adhesive on the trailing flap (so that the roller will not be contaminated by moistened adhesive). The input and output path of the envelope are displaced, and the direction of travel of the envelope substantially reversed, to provide a folding and sealing arrangement with a smaller "footprint". Disadvantages of this proposal include (a) that the moistener for each side flap normally rests in a water trough, which can overflow, and in use is spring biassed towards contact with the envelope (presumably after removal from the trough by means not shown), and (b) that a "gate" is normally held in the lifted condition by a solenoid, to pivot and drop into contact with the adhesive spots on the trailing flap when the solenoid is de-activated, the gate normally resting in the water trough and so being wetted; the positioning of the pre-applied adhesive has accurately to be coordinated with the selected timing of the subsequent gate drop.

U.S. Pat. No. 4,898,323 discloses a one piece mailer which includes a standard sized sheet which may be employed in laser printers or xerographic machines without special equipment, and involves printing on one side only of the mailer. In one embodiment a water activated adhesive is used, but selected so as not to become sticky at the temperatures likely within the above machines; in an alternative embodiment, the adhesive alternatively selected is pressure-sensitive, normally covered with a strip of release coated protective sheet.

U.S. Pat. No. 4,573,672 discloses a device for folding sheet material such as paper, with four rollers running in parallel to each other in a frame, the rollers being driven by a common electric motor. The rollers are in contact with each other to form a plurality of nips for taking up the sheet material to form folding lines. No means for sealing the folded sheet as a "self mailer" is taught.

SUMMARY OF THE INVENTION

According to one feature of our invention we provide mailing apparatus for a mailing sheet having a printed lower face which includes sheet feeding means, sheet folding means and sheet adhesive application means, said means determining a flow path for the mailing sheet, the sheet adhesive application means having a first part above the flow path and a second part below the flow path characterised in that the second part is downstream of the first part.

According to a further feature of our invention we provide mailing apparatus for pre-printed sheets which includes sorting means to select a sheet, transport means to move the sheet past first adhesive applicators spaced transversly across the direction of sheet feed, first feed means to direct the sheet towards a first buckle chute to form a first sheet bulge, first gripping means to engage the first sheet bulge and to withdraw part of the sheet from the first buckle chute and past second adhesive applicators spaced transversly across the direction of sheet withdrawal from the first buckle chute, second feed means means to direct the bulge and said part towards a second buckle chute to form a second bulge, second gripping means to engage the second bulge and withdraw the sheet from the second buckle chute past third adhesive applicators spaced transversely across the direction of sheet withdrawal from the second buckle chute.

Usefully the second and third adhesive applicators are mounted respectively on the first and second buckle chutes, suitably rigidly mounted; the first adhesive applicators are mounted with the transport means on the apparatus base. Desirably however the second and third adhesive applicators are mounted on the folder/sealer separately from the folder buckle chutes, so as to be removable for servicing e.g. replacement and/or cleaning whilst the buckle chutes remain in position; this arrangement will also more readily permit the accurate re-positioning necessary for a folder/sealer with a high sheet throughput e.g. over 1000 sheets/hour.

Preferably the adhesive applicators are spaced away from the sheet flow path so that the sheet does not contact the applicators; usefully therefore each applicator is connected to a pot containing flowable adhesive under pressure. Preferably the first adhesive applicators each have a nozzle adjacent the sheet feed path, and spaced from the first feed means a distance selected so that the trailing sheet edge flexes towards the nozzle to wipe residual adhesive from the nozzle.

The first feed means will typically be a pair of rollers, driven in opposite angular directions with the sheet being drawn therethrough. In accordance with an important feature of the invention the roller contacting the sheet face to which adhesive has or could be applied by the first adhesive applicators is grooved to avoid contact with the adhesive. In accordance with another important feature of the invention the first buckle chute has a inlet edge corrugated so that the edge does not contact the adhesive.

Control means permit the respective adhesive applicators to be energised at set intervals after entry of the preceding sheet into the first buckle chute. Additional control means stop the machine if overlapping sheets are sensed, and slow the machine if the sheet has followed too closely behind the preceding sheet. Multiple control points acting in parallel can be provided around the machine to permit operator control from more than one position.

According to another feature of the invention we provide a method for producing a mailable document from a stack of sheets each having a leading edge, a trailing edge and side edges joining said leading and trailing edges, the sheet being pre-printed on one face and stacked with the print facing downwards, which includes the steps of selecting a sheet from the bottom of the stack, feeding the sheet, leading edge first, under a transverse row of adhesive applicators energised to apply adhesive (a) adjacent to said side edges but at a position away from the leading edge, and (b) adjacent the trailing edge of the sheet, feeding said sheet through drive rollers at least one of which has cut-away portions aligned with said adhesive, and passing said sheet into a buckle chute to fold the sheet, whereby to adhere at least said trailing edge to the non-print face adjacent said fold. Preferably there are two buckle chutes arranged to provide a mailable document with a Z-fold. Preferably the region between the fold and the trailing edge is pre-printed with an address.

Also according to the invention we provide a method for preparing a self mailer which includes the steps of selecting a sheet from a stack of sheets pre-printed on their underside, transporting the sheet, leading edge first, under a transverse line of first adhesive applicators, projecting adhesive from the first adhesive applicators onto the upper face of the sheet at a predetermined time and for a predetermined interval, the interval for the outermost applicators being longer than for the remaining applicators, gripping the leading edge between first nip rollers with one roller segmented to contact the upper face of the sheet between the lines of adhesive, directing the said leading edge into and along a first buckle chute to form a first bulge, gripping the first bulge in a second pair of nip rollers to withdraw the sheet from the first buckle chute and carrying it towards and along a second buckle chute to form a second bulge and past second adhesive applicators, projecting adhesive from the second applicators at a predetermined time and for a predetermined interval, said time and said interval being different to those for the outermost of the first adhesive applicators, the adhesive being projected at the said underside of the sheet, gripping the second bulge in a third pair of nip rollers (a) to withdraw the sheet from the second buckle chute whilst applying adhesive to the underside intermediate the leading and trailing edges of the sheet, and (b) to press the overlying sheet lengths firmly together.

According to a further feature of the invention we provide a mailable document prepared from a sheet having on its one face an address region and an information region, said regions being separated by a fold line, one of said regions on the opposed face of the sheet having a long length of adhesive along each side edge, and said one of said regions on the said opposed face having a plurality of short lengths of adhesive extending parallel to said long lengths and spaced apart across the sheet edge.

Preferably the mailable document is prepared from a sheet having on one sheet face first, second and third regions, the first region being separated from the second region by a first linear fold line, the second region being separated from the third region by a second linear fold line, the fold lines being parallel, the third region having on the opposed sheet face a side line of adhesive adjacent each side edge and edge lines of adhesive parallel to said said side lines and therebetween and adjacent the free edge of the sheet, said edge lines being shorter than said side lines, said first region having a side line of adhesive adjacent each side edge, and said second region having edge lines adjacent the first fold line. The mailable document has a Z-fold, with the opposed face of the third region being an address or designation region.

Possibly the self-mailing document so produced is fed between a first pair of perforating rollers, and is then moved at right angles thereto between a second pair of perforating rollers, whereby all four edge portions of the mailing document are perforated. Preferably however the self-mailing document is first fed between a first pair of laterally-spaced perforaters so that the document longitudinal side edges are perforated, and then laterally thereto past a single perforater adjacent the leading paper edge i.e. that first fed to the folder/sealer.

DESCRIPTION OF THE DRAWINGS

The invention will be further described by way of example with reference to the accompanying schematic drawings, not to scale, in which.

DESCRIPTION OF DRAWING EMBODIMENTS

Sheets 10 are stacked in holding unit 14, and are pre-printed, for instance with personal information and the address of the intended recipient, and thus holding unit 14 may be placed at the exit of a laser printer or the like (not shown).

Figures 1, 2, 3, 4:
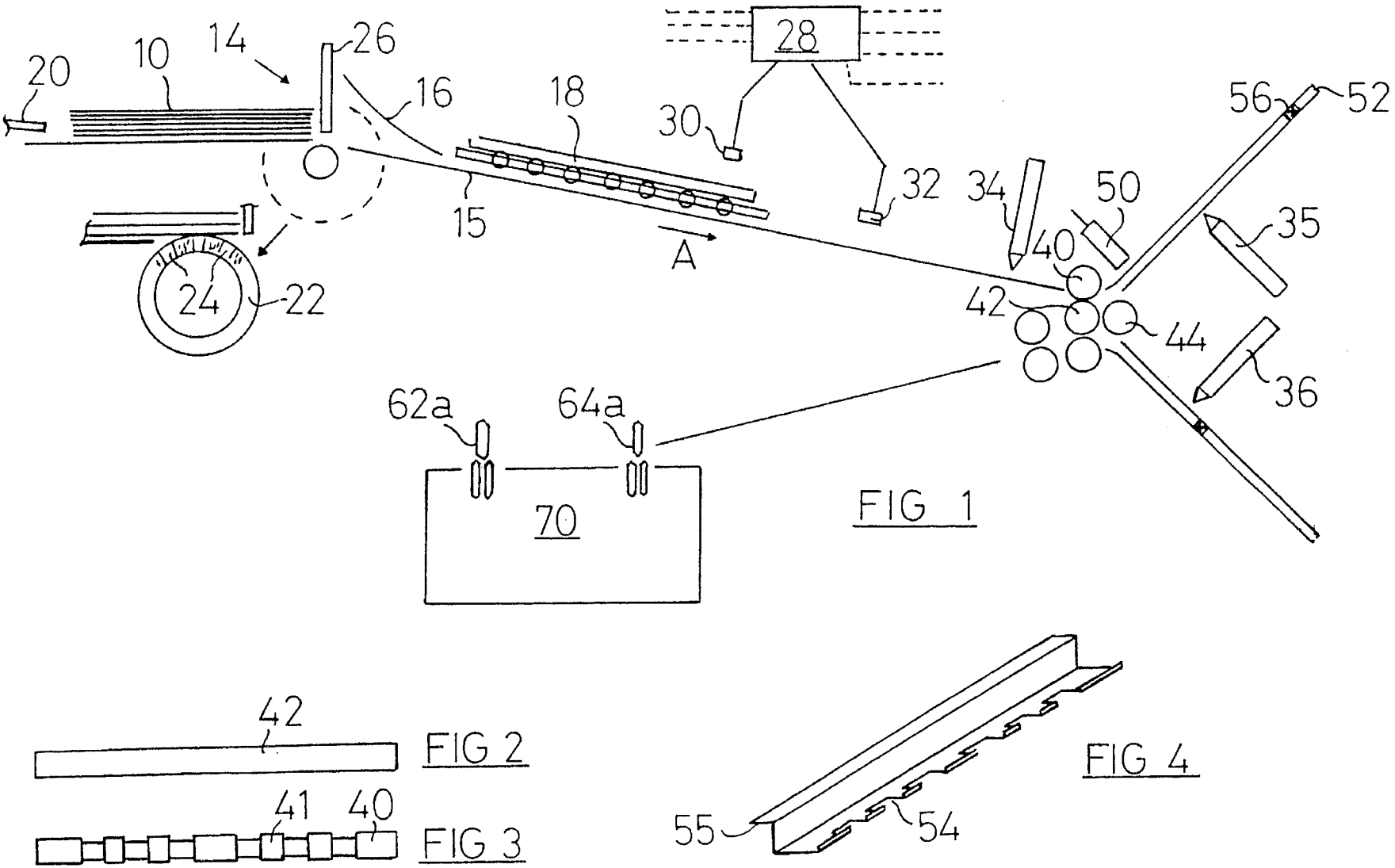
FIG. 1 is a side view of apparatus according to the invention, suitable for folding, and sealing with a Z-fold, pre-printed sheets.
FIG. 2 is a plan view of known rollers used in the apparatus of FIG. 1.
FIG. 3 is a plan view of modified rollers used in the apparatus of FIG. 1.
FIG. 4 is perspective view of an entrance component for the first buckle chute.
Figure 5:
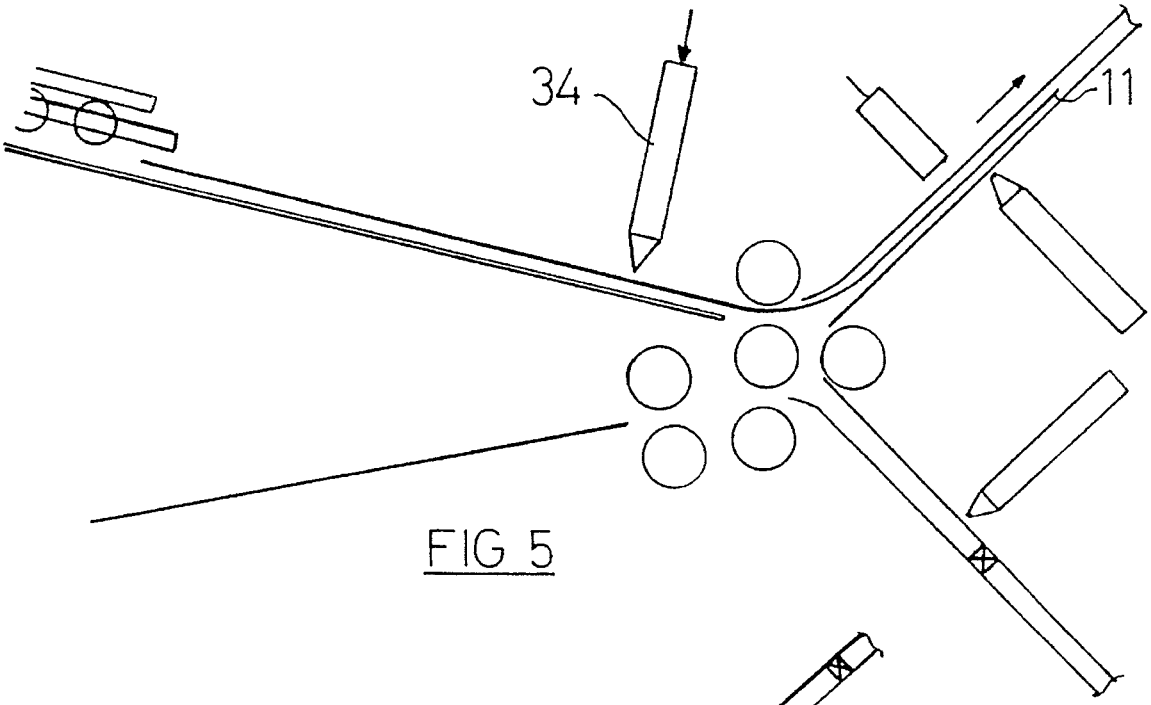
FIG. 5 is an enlarged detailed view of the apparatus of FIG. 1 being used for the first method step.
Figure 9:
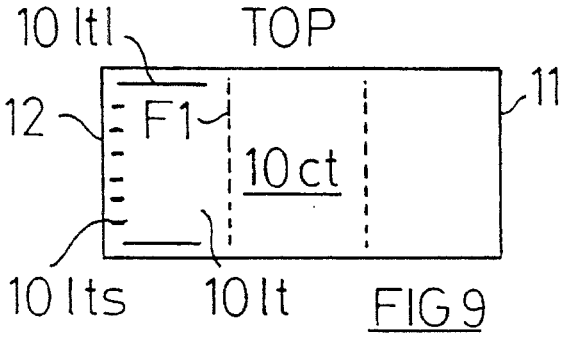
FIG. 9 is a view from above of a flattened sheet, with adhesive side "long-lines" and central "short-lines", following the method step of FIG. 5.

As stacked in FIG. 1, sheets 10 have their printed side downwards, and with the respective pre-printed address in the left-hand third of each sheet, marked 10*lb* in FIG. 10 since it is the bottom region as stacked i.e. below the corresponding top left hand region 101*t* of FIG. 9.

When in operation a sheet is collected and moved onto conveyor 15, the pre-printed address is thus on the trailing underside region of the sheet 10, being held in alignment on the conveyor by sprung guide 16 and ballbearing top drive 18.

Air jet 20 directs a flow of air towards the lowermost sheets of the stack, causing the sheets to "float", so permitting the lowermost sheet to be collected by hollow vacuum roller 22 by way of radial orifices 24. Conveniently a single pneumatic pump (not shown) is used, with its air outlet connected to air jets 20, and its air inlet connected to vacuum rotor 22.

Gate 26 acts (a) as a front stop for the stack, (b) to help ensure air separation of the lower sheets of the stack, and (c) limiting the number of sheets which can be removed together.

Whilst sheet 10 is being moved at speed by the belt conveyor 15 past the ball-bearing top drive 18, it passes under a double detector 30, which senses the light intensity transmitted through the sheet(s) from a light source (not shown), and by way of the central control unit 28 stops the apparatus if this intensity falls below a threshold value. A low light indication warns that two or more sheets are incorrectly being fed together through the apparatus; if multiple overlapping sheets are so detected, the machine is stopped before the sheets can be fed into the first pair of fold or nip or drive rollers 40,42.

The sheet 10 then passes below an interrupter eye 32, which senses the presence of the sheet and in particular therefore the interval which has elapsed between passage of the sheet leading edge 11 (FIG. 9), and trailing edge 12 of the preceding sheet (and similarly for succeeding sheets); if the sheets are feeding too close one after the other i.e. with insufficient gap, the interrupter eye 32 sends a signal to the apparatus control unit 28 to slow the speed of hollow rotor 22.

Figure 11:
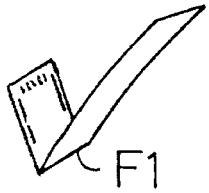
FIG. 11 is a perspective view of a mailing document at the completion of the method step of FIG. 5.

The sheet 10 thereafter passes beneath the jets or nozzles of a transverse row of first adhesive applicators 34. In this embodiment, there are six applicators 34 spaced across, but above, the flow path A of the sheet; only one applicator 34 can be seen in FIG. 1. As will be described in relation to FIGS. 9 and 11, the two outermost applicators are energised so as to apply long-lines 10*ltl* of adhesive adjacent to side edges of the sheet, for the first region 10*lt* i.e. the trailing third of the sheet upper face, whilst the inner applicators are energised later and for a shorter period to each deposit a spot or small line 10*lts* of adhesive near the trailing edge 12 of the sheet.

In this embodiment the adhesive is contained within two tanks (not shown) one of the tanks being connected to the applicators e.g. 35, selected for long-line adhesive deposit, and the other for connection to the applicators e.g. 36, selected for spot or short-line adhesive deposit.

The adhesive is ejected from the respective applicator nozzle or jet under pressure, sufficient to cross the gap to the sheet, and controlled by electronically operated air pressure valves (not shown). The timing of the adhesive application is controlled by signals from the electric eye 50 mounted on first fold plate or buckle chute 52. Conveniently, a test sheet is first passed through the apparatus so that the required delay can be preset into the control unit 28 i.e. the time interval between the sensing by the electronic eye of the leading edge 11 of a sheet and the desired application of adhesive to a selected area of the succeeding sheet.

Figure 17:
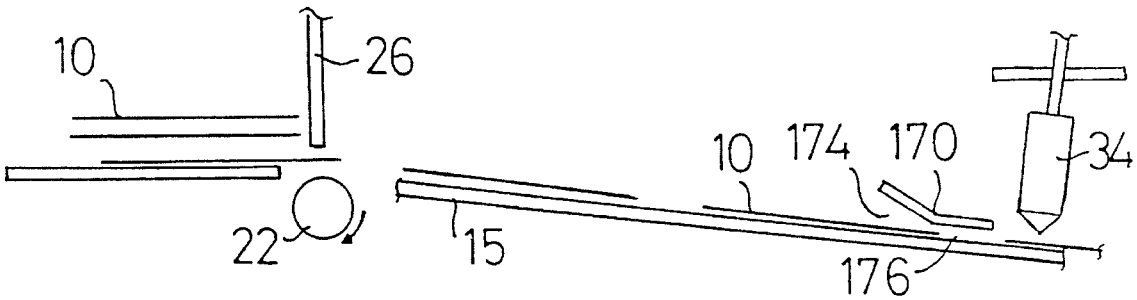
FIG. 17 is a part side view of an alternative embodiment to that of FIG. 1.
Figure 18:
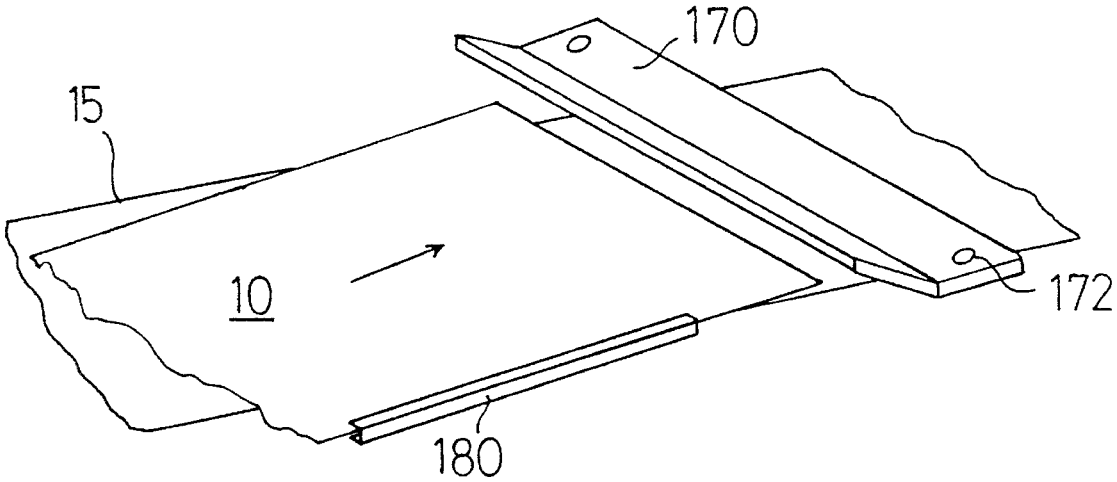
FIG. 18 is a perspective view of part of the apparatus of FIG. 17.

In a modified arrangement (FIGS. 17,18), the sheet 10 is directed below the first set of adhesive guns 34 by an angled cross-plate 170 mounted by screw holes 172 to either side of the conveyor 15. An important purpose for mouth 174 and throat 176 of cross-plate 170 is to flatten each sheet 10 prior to its reaching the row of applicators 34, for uniform adhesive application. In a particular embodiment (FIG. 18) at one side of the conveyor 15 the sheet 10 is located in a channel 180 with the conveyor being at a small angle to this channel.

Figure 20:
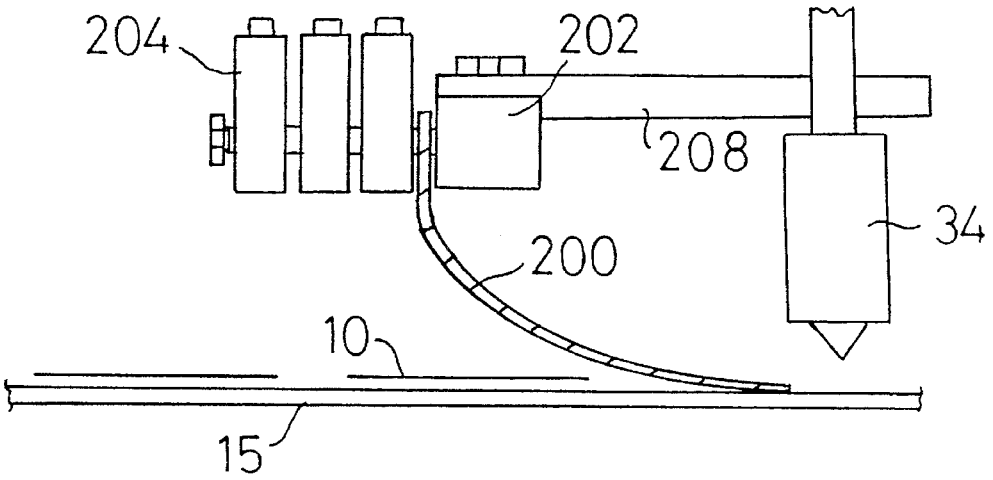
FIG. 20 is a part side view of another alternative embodiment to that of FIG. 1.
Figure 19:
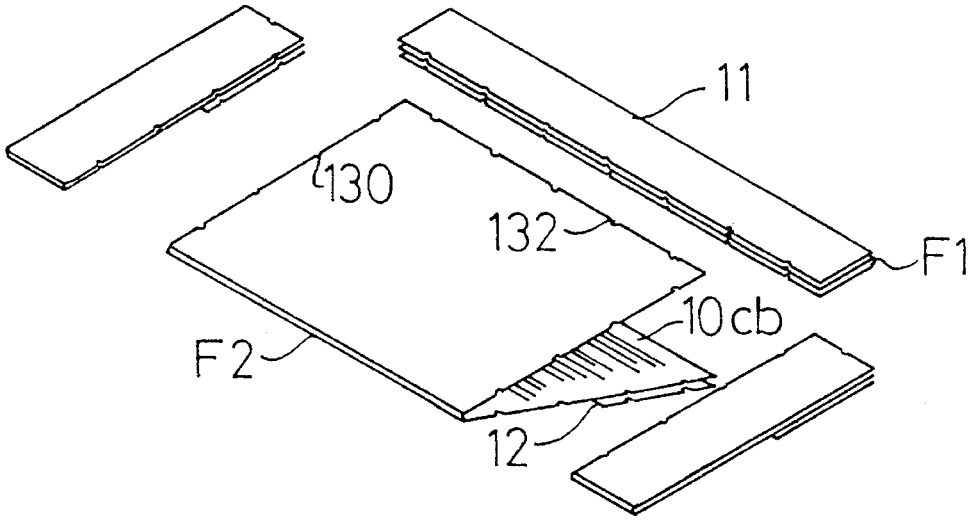
FIG. 19 is a perspective view of a perforated mailing document.
Figure 21:
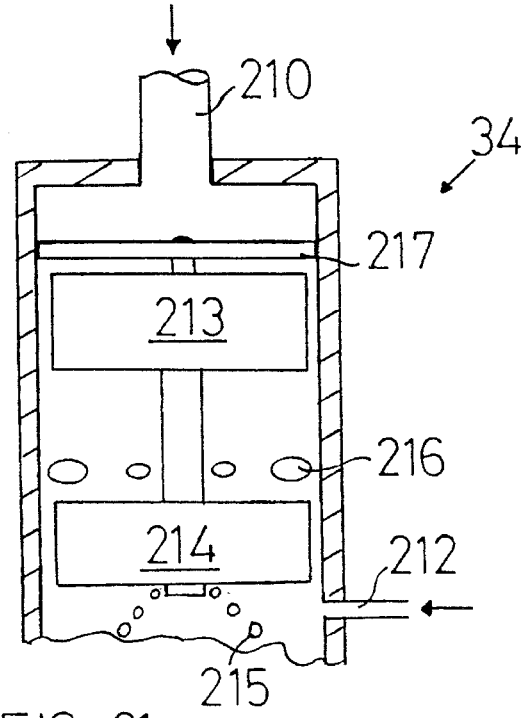
FIG. 21 is a cut-away view of part of a modified adhesive applicator.
Figure 22:
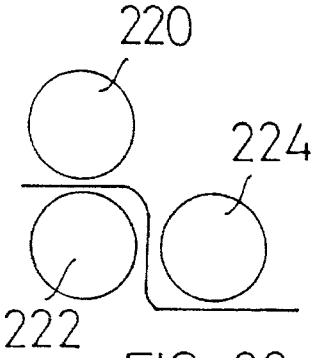
FIG. 22 is a side view of one embodiment of perforater feed rollers.
Figure 25:
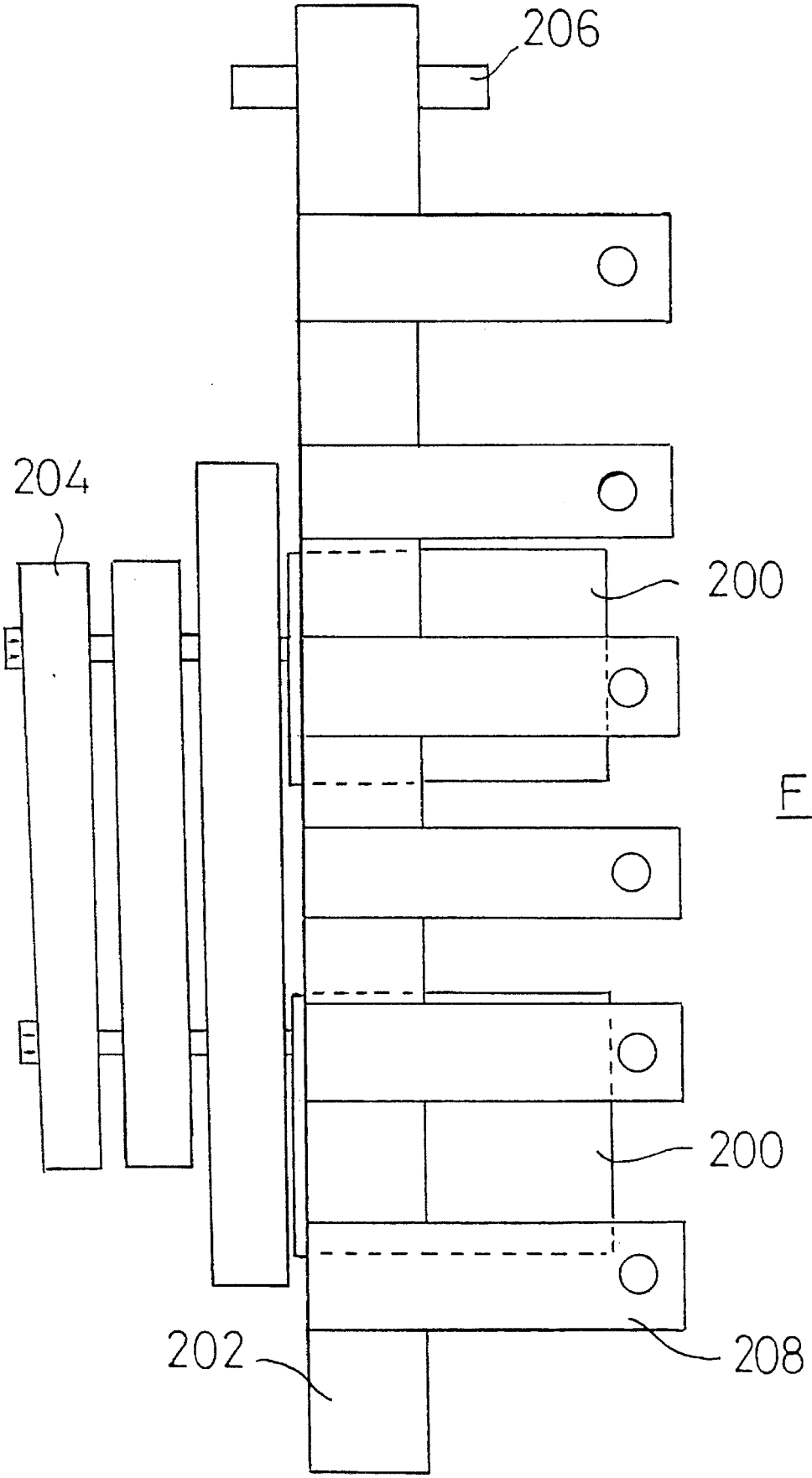
FIG. 25 is a plan view of the pivotable mounting for the first adhesive applicators.

In a further modified arrangement (FIG. 20) the sheet 10 is urged against conveyor 15 by spring steel fingers 200 secured between mounting bar 202 and adhesive pressure equalising manifolds 204. Mounting bar 202 is pivoted to the apparatus fixed base by cross-pin 206 (FIG. 25), allowing it and the applicators 34 (not shown in this figure for clarity) carried by struts 208, to be pivoted clear of the conveyor 15 for cleaning.

The sheet 10 passes between first nip rollers 40 and 42 and leading edge 11 is directed into first buckle chute or fold plate assembly 52. Roller 42 is of conventional form, and is seen in FIG. 2. Roller 40 however is of castellated form, with raised portions 41 to grip a sheet to the side of the adhesive long-lines and short-lines (spots). Thus the adhesive is not transferred onto roller 40, even when as described below in relation to FIG. 6 the bulge 1 is pulled into buckle chute 60.

Importantly the entrance to first fold plate 52 has cut-away portions, to prevent the adhesive being wiped onto the entrance of the buckle chute should region 10*lt* flex out of the intended flow path. FIG. 4. shows a buckle chute removable entrance component 55, with such recesses 54.

Figure 16:
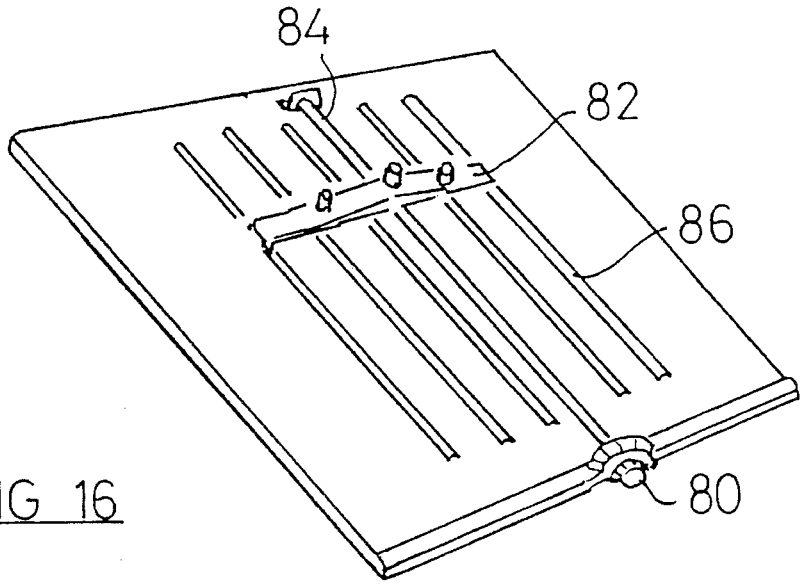
FIG. 16 is a perspective view of a buckle chute, with adjustable abutment.

Chute abutment 56 (FIG. 1) is adjustable in position along the chute, as is also described in relation to FIG. 16, and in this embodiment is set so that nearly two thirds of the sheet length (measured in the flow direction A between leading 11 and trailing 12 sheet edges) is accepted into the chute, to ensure that the first bulge when it occurs in known fashion is directed between nip rollers 42,44 and with the resulting fold F1 (FIGS. 9,11) correctly positioned.

Figure 6:
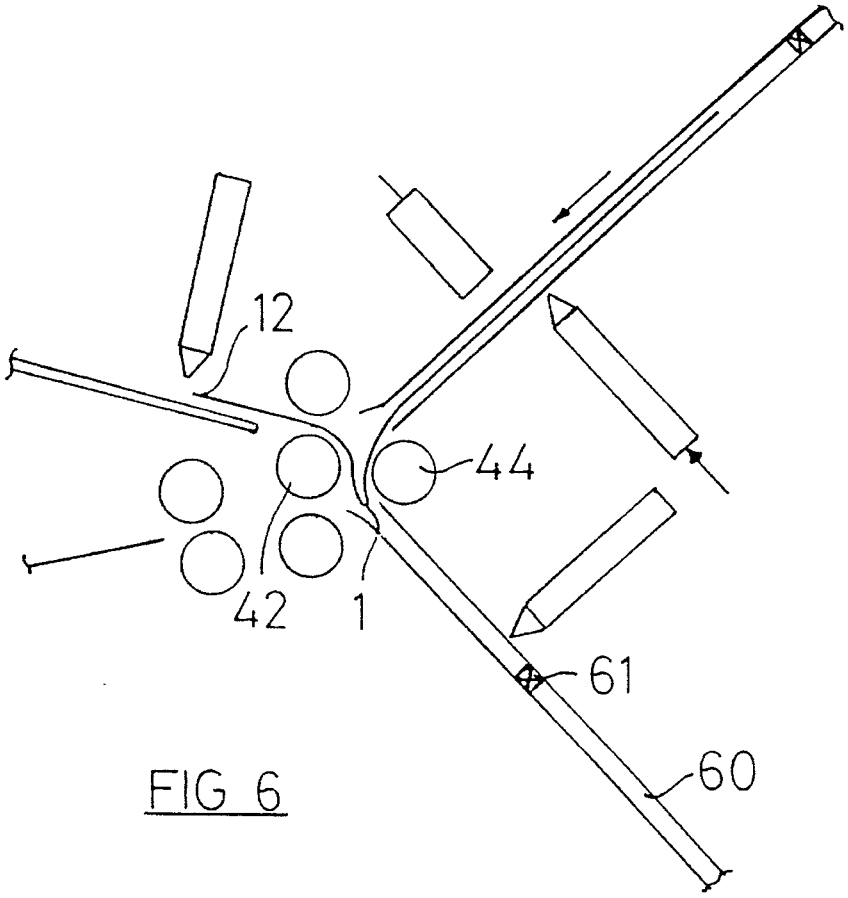
FIG. 6 is a view similar to that of FIG. 5 but for the second method step.

FIG. 6 shows the first bulge 1 already gripped between rollers 42 and 44 (to provide the fold line 3 (FIGS. 9,11) two thirds back from leading edge 11), and being fed into the second fold plate or buckle chute 60, towards abutment 62. During this movement, adhesive applicators 35 (two nozzles transversly spaced, though only one is seen) each apply a line of adhesive to the side edges of the now-trailing third 10*rb* of the sheet (FIGS. 10,12) i.e to a pre-printed face region of sheet 10.

As viewed in FIG. 7, the "left-hand" third (FIG. 10, 10*lb*) of each sheet (address section) has been squeezed into adhesive engagement with the "centre" third; the information sections to the opposite face of the sheet (below the flow path) make an obtuse angle about roller 44.

Figure 7:
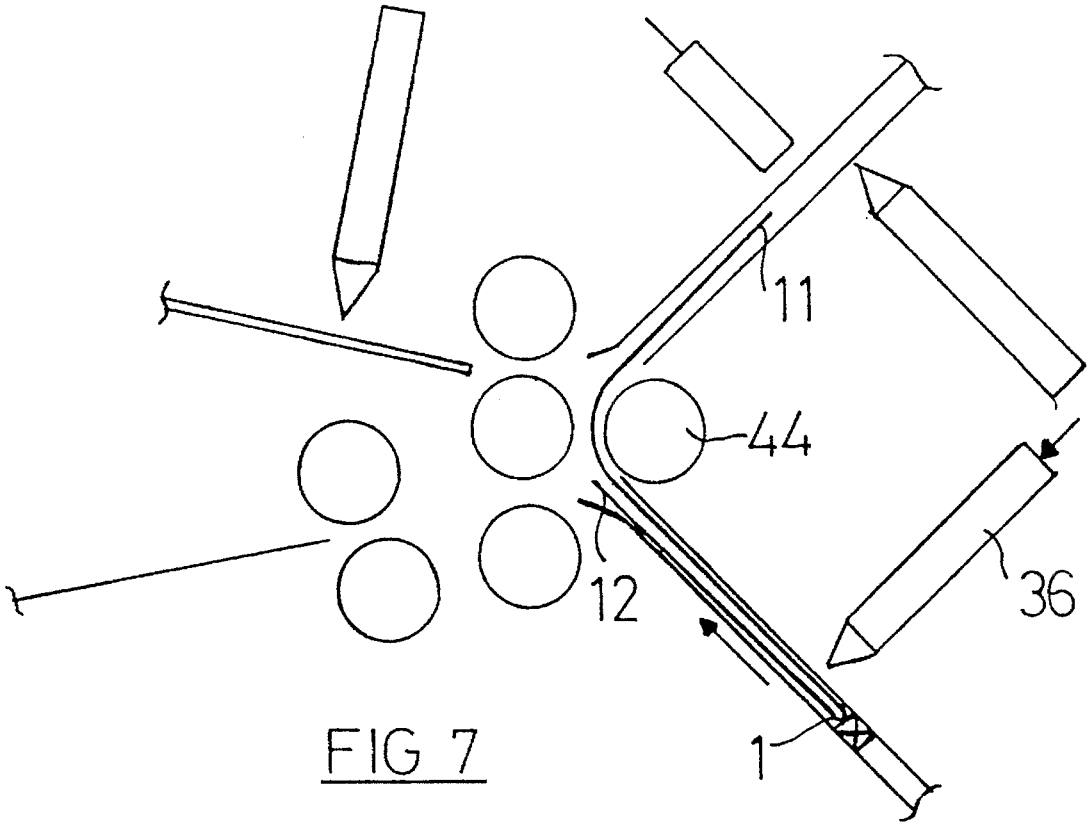
FIG. 7 is a view similar to that of FIG. 5 but for the third method step.
Figure 8:
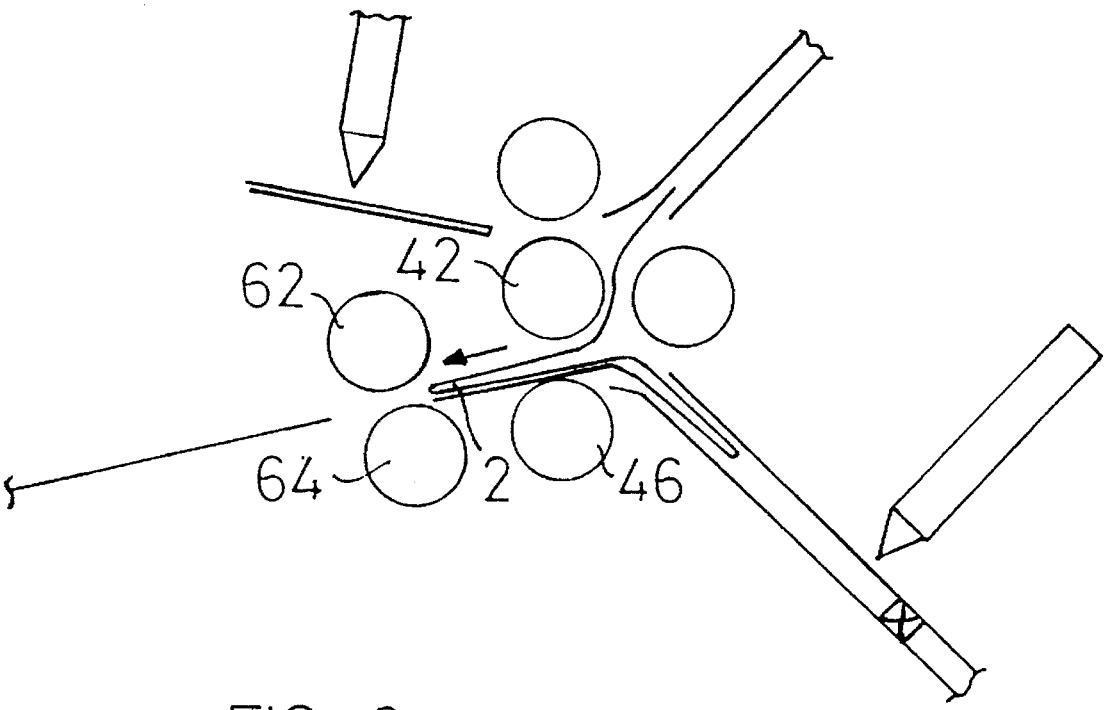
FIG. 8 is a view of FIG. 5 but for the fourth method step.
Figure 10:
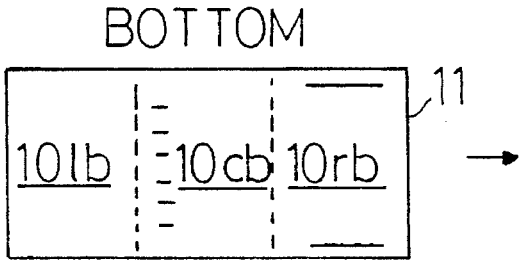
FIG. 10 is a view from below of the underside (as stacked) of a flattened sheet following the method step of FIG. 5, with the recipient address in the left-hand third.
Figure 12:
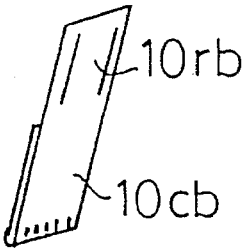
FIG. 12 is a perspective view of a mailing document at the completion of the method step of FIG. 7.

When the now compressed first bulge 1 hits abutment 61, with continued sheet feed out of the first buckle chute a second bulge 2 is formed (FIG. 8) and this is caught between rollers 42 and 46 so that the sheet is drawn to the left as viewed in FIGS. 7,8; during this movement, applicators 36 are energised to apply short-line or adhesive spots as indicated in FIGS. 10,12 to the new trailing end region 10*cb* of the partly folded sheet, though in an alternative embodiment applicators 36 are energised just prior to bulge 1 impacting abutment 61 or concurrently with the change of movement direction of bulge 1 (now fold line F1). As bulge 2 is caught and squeezed to form fold line F2, the sheet information sections (FIG. 12 10*rb*, 10*rc*) are also squeezed together between rollers 42,46 into adhesive engagement (see also FIG. 10)

With the above described arrangement, it is not necessary for either of rollers 42,46 to be castellated for adhesive-avoidance, and thus the sheet is desirably firmly folded across its width as it exits from the apparatus between rollers 42,46. Rollers 42,46 are adjustable by known means (not shown), as are rollers 40,44, to vary the nip settings e.g. 3× paper thickness.

Figure 13:
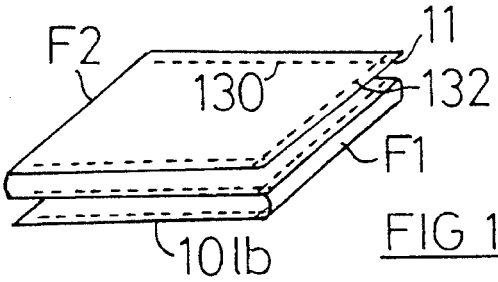
FIG. 13 is a perspective view of mailing document at completion of the method step of FIG. 8, and after presentation to the perforation wheels.

The folded sheet, now in the sealed form as shown in FIG. 13, is fed to the left (as viewed in FIG. 8) between pairs of perforating wheels 62,64; one pair of the perforating wheels are disposed at each side of the folded sheet but spaced inwardly form the side edge so that the long-line of adhesive is between the perforations 130 and the side edge.

In one embodiment, the perforated sheets are subsequently fed onto cross fold unit 70, so as to change the direction of folded sheet movement through 90 degrees i.e. to movement out of the paper as viewed in FIG. 1, with the folded sheet passing between one or other of perforating rollers 62*a*, 64*a*, whereby to perforate one of the other two edges of the folded sheet or mailing document with a perforation line 132 (FIG. 13). It will be understood that the folding facility is not operative for this application. It will also be understood from a study of FIG. 13 that upon the edge portions and adhesive being removed after tearing perforations 130,132 the upper and central sheet sections as viewed can be opened about fold line F2. It will also be understood that the lower sheet section can be removed by rupturing the adhesive holding edge 12 to the central section 10*ct*.

Although in this embodiment the fold lines F1,F2 are equally spaced from leading a trailing sheet edges 11,12, in an alternative embodiment the address region to be discarded by the recipient (or used for other purpose e.g. as a reply slip) and provided by 10*lt*/10*lb* can be smaller in length (in the flow path direction) than 10*ct* in accordance with the adjustment 56 of the buckle chute 52.

Figure 23:
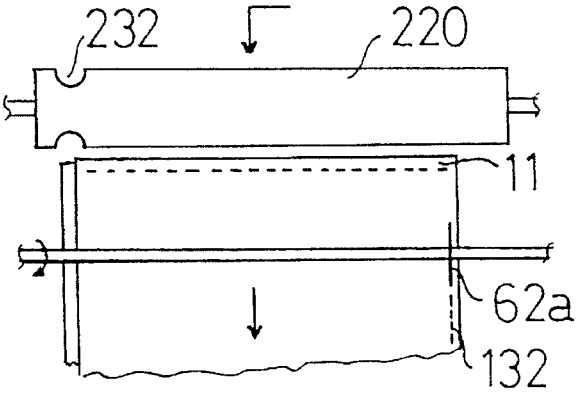
FIG. 23 is a plan view of the second stage perforater.

Usefully the perforating disc 62*a* (FIG. 23) is preceded by a flattening roller 230 so that the perforations 132 are parallel to edge 11. The roller 230 has a groove in alignment with edge 12 and fold line F2, to avoid the roller being fouled by excess adhesive squeezed from between 10*lt* and 10*ct*.

The document feed to the perforater 62*a* can be a single pair of rollers 220,222, but in the embodiment shown three rollers 220,222,224 are used (to help ensure flatness of the folded and sealed sheet prior to the second perforation), with rollers 220,224 being grooved at 232.

The finished mailing document can now be stacked, for despatch, and preferably this will be effected automatically by known apparatus (not shown) positioned at the exit from the cross-fold unit.

The preferred embodiment of the apparatus has separate controls, one for each of the folder units (buckle chutes) and one for the interrupter. The speed controls of both folder units are independent. In normal running, the motor would be switched on, the suction and blow would be switched on, the cross fold units would be running whilst the feed rate would be controlled by the interupter.

As the trailing edge of the sheet passes the applicators 34 (FIGS. 1,6), the terminal end or trailing edge 12 can flex or flick up and wipe these applicator nozzles clean of adhesive.

Figure 14:
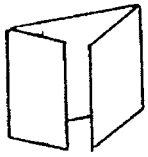
FIG. 14 is of an alternative embodiment of mailing document, of C-form.
Figure 15:
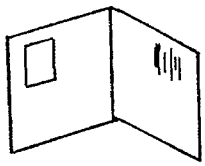
FIG. 15 is a perspective view of an alternative mailing document, of V-form.

As is known in the art, the number and disposition of the nip rollers and buckle chutes can be used to determine the number of folds, and the direction of fold. Thus FIG. 14 shows a known C-fold, whilst FIG. 15 shows a known "V" fold.

Furthermore, each chute can have an adjustable abutment, a useful embodiment being shown in FIG. 16, using manually rotatable knob 80 to adjust the position of abutment bar 82 by way of a screw 84 and thread connection. The bar has projections which extend into apertures 86, into the intended flow path of the sheet.

The arrangement herein disclosed permits very accurate adhesive application, longitudinally of the sheet and laterally, with optical eye 50 detecting the leading edge of a sheet, to effect timed application of adhesive by applicators 34, 35, 36 for the following sheet(s). Furthermore the interrupter 32 can sense the gap between sheets and control the feed rate by hollow roller 22.

Figure 24:
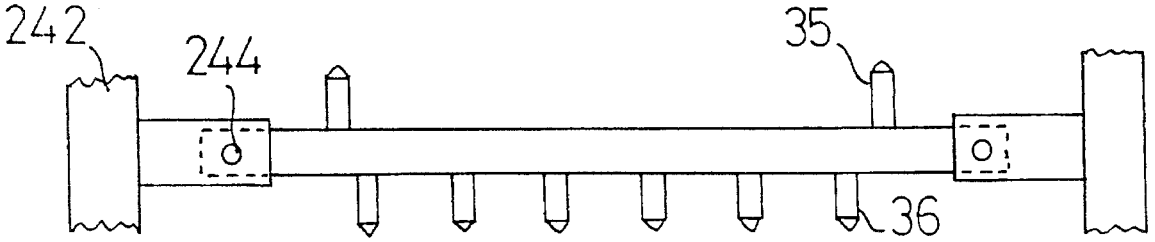
FIG. 24 is a side view of part of a detachable mounting for the second and third adhesive applicators.

We now provide three sets of adhesive applicators or glue guns, the applicators of each set preferably being transversely of the feed direction and at calculated positions along the flow path, to avoid the need for individual applicator control (though this is possible in a less preferred embodiment). Thus we provide the facility for the user to vary the positions of the applicator sets 34,35,36, with of course any necessary compensating adjustments to the timing of adhesive application utilising optical sensor 50 and control unit 28. Applicator sets 35,36 can be removed from the apparatus (as for cleaning) along with their mounting bar 240 (FIG. 24). Mounting bar 240 is rigidly held to the apparatus side frame 242 by pins 244.

We modify the "gates" on the fold plates in order to avoid fouling of the gates with adhesive. Furthermore, we also modify one of each of the first and second pair of nip rollers; in this embodiment a common roller is used for each pair. We further modify known folding apparatus by providing adhesive applicators on the folding unit, with separate applicators, i.e. one set on each of the fold units.

We have also modified the "glue guns" 34,35,36 to achieve a shorter response time, so as to permit a faster sheet throughput i.e. over 10,000 sheets each hour. Thus glue gun 34 for example has a pneumatic line 210 to the upper end (as shown) of cylinder 211, the lower end of which has connected thereto an adhesive line 212. Downward movement of pneumatic piston 213 effects corresponding downward movement of secondary piston 214 against spring 215 to expel adhesive towards a sheet 10 in accordance with a signal to the pneumatic supply from controller 28. To limit the escape of pressurised air through exit orifices 216, we fit a resilient flap 217 to the pneumatic piston and which during the pressure actuation stroke (downward as viewed) seals against the cylinder walls, utilising more of the supplied pneumatic energy.

Various alternative mail documents, method and apparatus are possible. The sheets can be fed printed side upwards in the stack, and fed address region first, utilising the same folding/sealing sequence; the paper can be fed to the stack from web, and cut to length immediately prior to stacking; the paper can be of various sizes e.g. A3, A4, with the settings on control box 28 altered accordingly, with perhaps a different number of the short-line adhesive applicators fitted or energised. An alternative method of removing individual sheets from the stack can be used e.g. manual rather than vacuum. The spacing between the first nip rollers (normally 2× paper width can be changed, as can the spacing between the second and third nip rollers (normally 3× paper width). These alternatives all permit production of a tamper-evident "self-mailer" at high speed, and of consistent quality, with minimum operator supervision; together with the facility for rapid apparatus programming to different paper sizes, fold configurations, adhesive application positioning, and (by nip spacing) paper thicknesses.

I claim:

1. Mailing apparatus for a pre-printed sheet (10) characterised by transport means (15,18) to move the sheet past first adhesive applicators (34) spaced transversely across the direction of sheet feed (A), first gripping means (40,42) to direct the sheet leading edge towards a first buckle chute (52) whereby to form a first sheet bulge (1), second gripping means (42,44) to engage the first sheet bulge to withdraw a portion of the sheet past second adhesive applicators (35) spaced transversely across the direction of sheet withdrawal from the first buckle chute, the second gripping means directing the first bulge towards a second buckle chute whereby to form a second bulge (2), third gripping means (42,46) to engage the second bulge and withdraw a different portion of the sheet from the second buckle chute past third adhesive applicators spaced transversely across the direction of sheet withdrawal from the second buckle chute.

2. Mailing apparatus for pre-printed sheets (10) characterised by sorting means (20, 22, 24, 26) to select a sheet, transport means (15,18) to move the sheet past first adhesive applicators (34) spaced transversely across the direction of sheet feed (A), the sheet having a leading edge and a trailing edge and side edges joining the said leading edge and trailing edge, the leading edge being the first to pass the first adhesive applicators, first gripping means (40,42) to direct the sheet leading edge towards a first buckle chute (52) whereby to form a first sheet bulge (1) spaced from said leading edge, second gripping means (42,44) to engage the the first sheet bulge to form a first crease line in the sheet and to withdraw a portion of the sheet between the first crease line and the said leading edge from the first buckle chute past second adhesive applicators (35) spaced transversly across the direction of sheet withdrawal from the first buckle chute, the second gripping means directing the first crease line towards a second buckle chute (60) to form a second bulge (2) spaced from the first crease line and towards the said leading edge, third gripping means (42,46) to engage the second bulge to form a second crease line and to withdraw the first crease line from the second buckle chute past third adhesive applicators (36) spaced transversely across the direction of sheet withdrawal from the second buckle chute.

3. Mailing apparatus according to claim 2 characterised by means to feed a folded sheet to sheet perforating means (62,64), the sheet perforating means having a first perforating station and a second perforating station, the first perforating station perforating opposed side edge portions of the folded sheet, and the second perforating station perforating adjacent and parallel to said leading edge.

4. Mailing apparatus for a mailing sheet which includes sheet feeding means (15), sheet folding means (52,60), and sheet adhesive application means (34,35,36), said means determining a flow path for the mailing sheet (10), the sheet adhesive application means having a first part (34) and a second part (35,36), said parts being spaced apart along the flow path, the first part (34) being upstream of the sheet folding means (15) and to one side of the flow path, said second part (35,36) being to the opposite side of the flow path and downstream of said first part (34), with said first part and said second part each having a first set of adhesive applicators, the first set being connected to a first adhesive supply at a first pressure, the second set of adhesive applicators being connected to a second adhesive supply at a second pressure, the first pressure being greater than the second pressure, the applicators of the second set of the first part being located inwardly of the applicators of the first set, where the first part (34) is mounted to pivot away from the sheet feeding means (15), and the second part (35,36) is mounted for removal independently of the sheet folding means (52,60), the first part carrying paper hold down means comprising a pair of spring plates having a paper engagement section parallel to the sheet feeding means (15).

5. Mailing apparatus according to claim 1 characterised in that the sheet adhesive application means are spray nozzles (34,35,36), said first part and said second part each having a first set of adhesive applicators, the first set being connected to a first adhesive supply at a first pressure, the second set of adhesive applicators being connected to a second adhesive supply at a second pressure, the first pressure being greater than the second pressure, the applicators of the second set of the first part being located inwardly of the applicators of the first set.

6. Mailing apparatus according to claim 2 characterised in that the sheet adhesive application means are spray nozzles (34,35,36), said first part and said second part each having a first set of adhesive applicators, the first set being connected to a first adhesive supply at a first pressure, the second set of adhesive applicators being connected to a second adhesive supply at a second pressure, the first pressure being greater than the second pressure, the applicators of the second set of the first part being located inwardly of the applicators of the first set.

7. Mailing apparatus according to claim 3 characterised in that the sheet adhesive application means are spray nozzles (34,35,36), said first part and said second part each having a first set of adhesive applicators, the first set being connected to a first adhesive supply at a first pressure, the second set of adhesive applicators being connected to a second adhesive supply at a second pressure, the first pressure being greater than the second pressure, the applicators of the second set of the first part being located inwardly of the applicators of the first set.

8. Apparatus for sheet folding and sealing to produce letter-like mailable objects from preprinted sheet material having a face and an obverse face, said apparatus having a first side and an opposite side in relation to said first side, said apparatus comprising:

a) a feeder located on said first side for feeding individual sheets in seriatim from said first side, said apparatus accepting sheets through said first side, b) at least one buckle chute, all of said at least one buckle chute being located on said opposite side, said at least one buckle chute including an adjustable abutment stop, c) fold and seal means for folding and sealing sheets in cooperation with said at least one buckle chute, said fold and seal roll means comprising a main drive roller and a first, a second, and a third roller, said main drive roller and said first roller forming a first nip therebetween, said main drive roller and said second roller forming a second nip therebetween, said main drive roller and said third roller forming a third nip therebetween, wherein sheets during folding and sealing thereof are fed by said feeder into said first nip and thereafter are fed by said first, said second and said third nips in that sequence therethrough, whereby folded and sealed sheets egress from first side; and d) adhesive applicator means for application of adhesive to sheets in said apparatus for mutual bonding of folded sheet portions, whereby said adhesive applicator means include first and second pairs of applicator nozzles for applying adhesive to said sheets along the direction of motion of the sheets, and adjacent said edges thereof, said first pair of applicator nozzles being disposed upstream of said first nip, said second pair of applicator nozzles being disposed downstream of said first nip but upstream of said second nip, said first pair of applicator nozzles being adjacent said face of fed sheet, said second pair of applicator nozzles being adjacent said obverse face of fed sheet.

9. Apparatus of claim 8 wherein the adhesive applicator means is spaced by a gap from the sheet flow path, with adhesive applied across said gap.

10. Apparatus of claim 8 which includes first and second buckle chutes, each having an adjustable stop and wherein the adhesive applicator means further includes first and second sets of spot applicator nozzles for applying adhesive spots in locations along a transverse direction with respect to the motion of the sheets, said first set being upstream of said first nip, the second set being disposed adjacent to said adjustable stop of said second buckle chute.

* * * * *